US008480416B2

(12) United States Patent
Farris-Gilbert et al.

(10) Patent No.: US 8,480,416 B2
(45) Date of Patent: Jul. 9, 2013

(54) TRANSFORMABLE ELECTRICAL PLUG DEVICES

(75) Inventors: Cezanne-Simon Farris-Gilbert, Long Beach, CA (US); Alan Chun-Ye Yeung, Santa Ana, CA (US)

(73) Assignee: Aviiq IP Inc, Hong Kong (CN)

( * ) Notice: Subject to any disclaimer, the term of this patent is extended or adjusted under 35 U.S.C. 154(b) by 0 days.

(21) Appl. No.: 13/432,380

(22) Filed: Mar. 28, 2012

(65) Prior Publication Data

US 2012/0252248 A1 Oct. 4, 2012

Related U.S. Application Data

(60) Provisional application No. 61/468,999, filed on Mar. 29, 2011, provisional application No. 61/584,088, filed on Jan. 6, 2012.

(51) Int. Cl.
*H01R 13/44* (2006.01)

(52) U.S. Cl.
USPC ..... 439/131; 439/640

(58) Field of Classification Search
USPC ..... 439/11, 103–107, 131, 166, 170–175, 439/640
See application file for complete search history.

(56) References Cited

U.S. PATENT DOCUMENTS

| | | | | |
|---|---|---|---|---|
| 3,299,390 | A * | 1/1967 | Eckelkamp | 439/39 |
| 3,825,875 | A * | 7/1974 | Garrett | 439/103 |
| 4,201,431 | A * | 5/1980 | McDonald | 439/103 |
| 5,159,545 | A | 10/1992 | Lee | |
| 5,611,701 | A | 3/1997 | Hahn | |
| 5,628,641 | A | 5/1997 | Hahn | |
| 5,658,152 | A * | 8/1997 | Selker | 439/31 |
| 6,062,884 | A * | 5/2000 | Messimer et al. | 439/172 |
| 6,273,734 | B1 | 8/2001 | Ikeda et al. | |
| D480,358 | S | 10/2003 | Klant | |
| 6,780,034 | B2 * | 8/2004 | Shiroshita et al. | 439/174 |
| 6,984,153 | B2 * | 1/2006 | Lai et al. | 439/640 |
| 6,991,469 | B1 * | 1/2006 | Wang | 439/31 |
| 7,052,298 | B1 * | 5/2006 | Cheng | 439/171 |
| 7,614,892 | B2 | 11/2009 | Klant et al. | |

(Continued)

FOREIGN PATENT DOCUMENTS

| | | | |
|---|---|---|---|
| GB | 2467644 | A | 8/2010 |
| WO | 2009/014460 | A1 | 1/2009 |

OTHER PUBLICATIONS

"International Travel Plug Adapter," retrieved from http://www.kensington.com/kensington/us/us/p/1415/K33117/international-travel-plug-adapter.aspx, on sale at least as early as Feb. 2011, 1 page.

(Continued)

*Primary Examiner* — Thanh Tam Le
(74) *Attorney, Agent, or Firm* — Seed IP Law Group PLLC

(57) ABSTRACT

A device is provided for establishing an electrical connection between an electrical plug and an electrical socket. The device includes a first body and a second body coupled together to move between a stowed configuration in which the first body and second body are substantially aligned in a common plane and a deployed configuration in which one end of the first body and one end of the second body cooperate to form a device socket for the electrical plug and in which the other end of the first body and the other end of the second body cooperate to form a device plug for the electrical socket. Methods of making a device for establishing an electrical connection between an electrical plug and an electrical socket are also provided.

28 Claims, 11 Drawing Sheets

U.S. PATENT DOCUMENTS

| | | | | |
|---|---|---|---|---|
| 8,157,574 | B2 * | 4/2012 | Hsiao | 439/131 |
| 2004/0097114 | A1 | 5/2004 | Shiroshita et al. | |
| 2007/0019422 | A1 | 1/2007 | Shau-din | |

OTHER PUBLICATIONS

"PHOTOS: UK folding plug and travel adapter—Pocket-lint," dated Sep. 16, 2009, retrieved from http://www.pocket-lint.com/news/27152/uk-folding-plug-travel-adapter, on Nov. 2, 2012, 4 pages.

"Universal Adapter Pugs for Travel Worldwide Use," retrieved from http://www.cross-mark.com/universal-adapter-plugs-travel-world-wide-p-966.html, on sale at least as early as Mar. 2008, 2 pages.

"Wholesale 2 Piece Plug Adapter—Customized Power Supplies/Inverters—#PPC200802," dated Jan. 11, 2010, retrieved from http://www.wellpromo.com/Wholesale/Power-Supplies-Inverters/2-Piece-Plug-Adapter-86781.htm, on Nov. 2, 2012, 2 pages.

* cited by examiner

TRANSFORMABLE ELECTRICAL PLUG DEVICES

CROSS-REFERENCE TO RELATED APPLICATIONS

This application claims the benefit under 35 U.S.C. §119 (e) of U.S. Provisional Patent Application Nos. 61/468,999, filed Mar. 29, 2011, and 61/584,088, filed Jan. 6, 2012, the entire disclosures of which are herein incorporated by reference for all purposes.

BACKGROUND

1. Technical Field

The present disclosure is related to electrical plug devices, and more particularly, to electrical plug adaptors and multi-socket plugs for establishing an electrical connection between an electrical plug and an electrical socket which are transformable between a stowed configuration and a deployed configuration.

2. Description of the Related Art

Travelers often take along electrical devices when traveling abroad that run on power and utilize electrical plugs that fit only into sockets of their country of origin. Consequently, when a traveler wishes to use a device in a country having sockets that do not correspond to the device, a direct connection cannot typically be made. Accordingly, adaptors to act intermediate of an electrical plug of one type and an electrical socket of a different type are known. Some adaptors feature multi-part construction wherein some parts are removed and other parts are added to reconfigure the adaptor to interface with various plug and socket combinations. These multi-part adaptors are often bulky and cumbersome to use and the separable parts are prone to loss. Other adaptors feature assemblies having movable or repositionable electrical contacts. These adaptors can wear prematurely and may create electrical hazards at the interface of the moving contacts.

In addition, in some instances a user may desire to plug in various powered devices where there are not enough sockets available for the devices. In such circumstances, it is often desirable to have an electrical multi-socket plug which is configured to multiply one socket into two, three, four or more sockets. Various known multi-socket plugs, however, suffer from a number of deficiencies. For example, many multi-socket plugs are quite bulky and thus inconvenient for the frequent traveler.

BRIEF SUMMARY

The devices and methods described herein provide for establishing an electrical connection between an electrical plug and an electrical socket of the same type or different types in a particularly robust and small form factor. The devices are particularly well suited for transitioning between a stowed configuration in which the device has a slender, elongated form and a deployed configuration in which the device is positioned to provide a coupling interface for the electrical plug and socket. In some embodiments, the device may provide USB charging ports for charging various electronic devices, such as, for example, smart phones, and may also include surge protection functionality.

According to one embodiment, a device for establishing an electrical connection between an electrical plug and an electrical socket may be summarized as including a first body and a second body. The first body may include a pair of female contacts at one end configured to receive male contacts of the electrical plug and a pair of male contacts at the other end configured to be insertably received in female contacts of the electrical socket. The female contacts may be fixedly and electrically coupled to the male contacts to enable completion of an electrical circuit when the device is in use without relying on brush contacts or the like. The second body may include a grounding contact at each of opposing ends thereof which are coupled together to provide grounding of the electrical circuit when the device is in use.

The device is movable between a stowed configuration and a deployed configuration. In the deployed configuration, opposing ends of the first body and opposing ends of the second body cooperate to provide a coupling interface for the electrical plug and the electrical socket. When the device is in the stowed configuration, the first body and the second body are substantially aligned in a common plane and may nest together or overlap with each other. In some embodiments, the first body and the second body may be substantially aligned in a common plane in an abutting fashion when in the stowed configuration. When the device is in the deployed configuration, the first body and the second body are substantially aligned in parallel offset planes. When the device moves from the stowed configuration to the deployed configuration, the first body and the second body may rotate independently.

The device may further include a linkage coupled to each of the device bodies. When the device is in the deployed configuration, a longitudinal length of the linkage may be perpendicularly aligned to a direction defined between opposing ends of the device bodies. The linkage may be hollow to receive electrical conductors routed between the device bodies. When the device is in the stowed configuration, a longitudinal length of the linkage may be aligned substantially parallel to a direction defined between opposing ends of the device bodies.

As an example and without limitation, when the device is in the deployed configuration, the device may be configured to receive a NEMA 5 type electrical plug and be inserted in a non-NEMA type electrical socket. In other embodiments, when the device is in the deployed configuration, the device may be configured to receive several NEMA 5 type electrical plugs and be inserted in a NEMA 5 type electrical socket. In addition, in some embodiments, the device may provide USB charging ports for charging various electronic devices, such as, for example, smart phones. The device may also have surge protection functionality.

A method of making transformable electrical plug device may be summarized as including forming a first body to include a pair of electrical conductors extending between opposing ends thereof to interface with an electrical plug and an electrical socket and enable completion of an electrical circuit therebetween and forming a second body to include an electrical conductor extending between opposing ends thereof to interface with the electrical plug and the electrical socket and provide grounding therebetween. The method may further comprise coupling the first body and the second body together to move between a stowed configuration in which the first body and the second body are aligned in parallel and/or nest together and a deployed configuration in which the opposing ends of the first body and the opposing ends of the second body cooperate to provide a coupling interface for the electrical plug and the electrical socket. Forming the first body to include the pair of electrical conductors extending between opposing ends thereof may include forming the first body to include a pair of female contacts at one of the opposing ends and a pair of male contacts at the other one of the opposing ends, the female contacts and the male contacts connected by the electrical conductors to enable completion of the electrical circuit when the device is in use. Forming the second body to include the electrical conductor extending between opposing ends thereof may include forming the second body to include a grounding contact at each of the opposing ends, the grounding contacts connected by the electrical conductor to provide grounding of the electrical circuit when the device is in use.

DETAILED DESCRIPTION

In the following description, certain specific details are set forth in order to provide a thorough understanding of various disclosed embodiments. However, one skilled in the relevant art will recognize that embodiments may be practiced without one or more of these specific details. In other instances, well-known structures and manufacturing techniques associated with electrical plug and socket adaptors, multi-socket plugs, surge protectors and USB charging port devices may not be shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Figure 1:
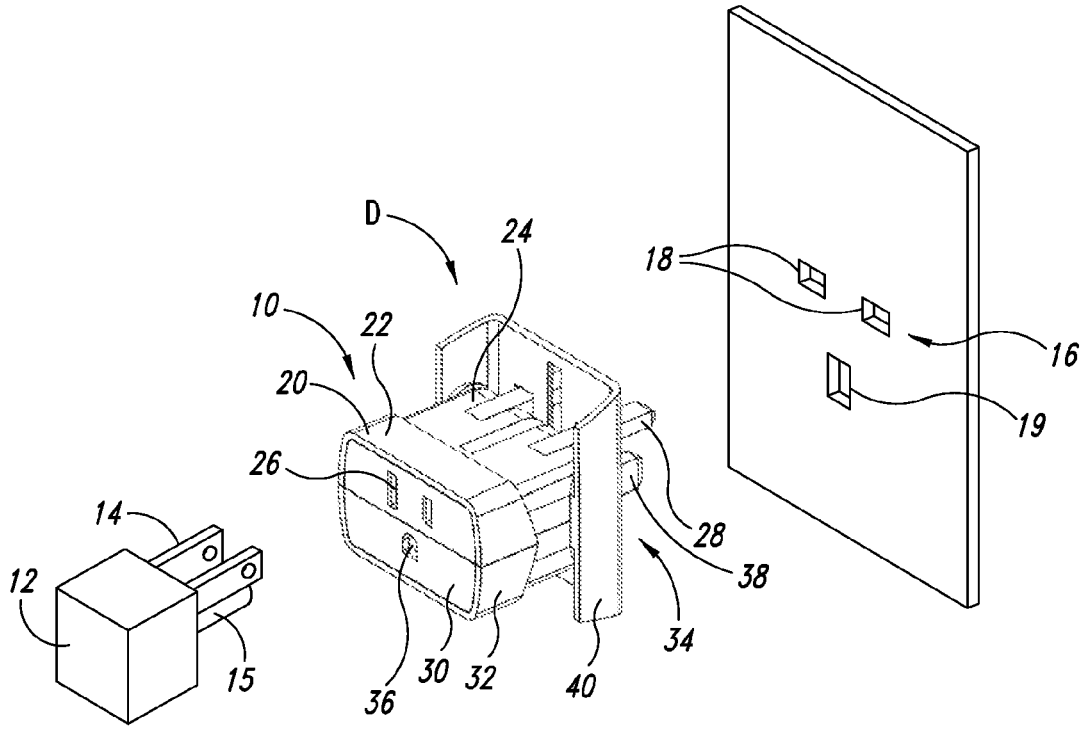
FIG. 1 is a rear isometric view of an electrical plug device, according to one embodiment, which is shown positioned between an electrical plug of one type and an electrical socket of another type.

FIG. 1 shows an electrical plug device in the form of an adaptor 10, according to one embodiment, for establishing an electrical connection between an electrical plug 12 of one type and an electrical socket 16 of another type. For example, the plug 12 illustrated in FIG. 1 includes contacts 14, 15 arranged as a NEMA 5 type electrical plug and the socket 16 includes contacts 18, 19 arranged as a BS 1363 socket. The adaptors 10 described herein, however, may be configured to interface with numerous types of well known electrical plugs and sockets and are by no means limited to the types of plugs and sockets illustrated in the figures.

The adaptor 10 includes a first body 20 and a second body 30 which cooperate to form a coupling interface for each of the electrical plug 12 and electrical socket 16. In this manner, the adaptor 10 advantageously enables the formation of an electrical connection between a plug and socket of different types.

The first body 20 includes opposing ends 22, 24 with a pair of electrical conductors extending therebetween and terminating in electrical contacts. More particularly, at one end 22, the first body 20 includes a pair of female contacts 26 configured to receive male contacts 14 of the electrical plug 12. At the other end 24, the first body 20 includes a pair of male contacts 28 configured to be insertably received in female contacts 18 of the electrical socket 16. The female contacts 26 of the first body 20 are fixedly and electrically coupled to the male contacts 28 to enable completion of an electrical circuit through the adaptor 10 when the adaptor 10 is in use without reliance on brush contacts or the like. The conductors and contacts 26, 28 of the first body 20 are preferably encased in a common, integral portion of the first body 20 to create a particularly robust form factor.

The second body 30 includes opposing ends 32, 34 with an electrical conductor extending therebetween and terminating in electrical contacts. More particularly, at one end 32, the second body 30 includes a female contact 36 configured to receive a male grounding contact 15 of the electrical plug 12. At the other end 34, the second body 30 includes a male contact 38 configured to engage a female grounding contact 19 of the electrical socket 16. In addition, or alternatively, the other end 34 may include a grounding contact at the outer perimeter of the body 30 for accommodating grounding contacts of different style plugs, such as, for example, a Type F or Schuko plug. The grounding contacts 36, 38 of the second body 30 are fixedly coupled together to provide grounding of the electrical circuit through the adaptor 10 when the adaptor 10 is in use. The conductor and grounding contacts 36, 38 of the second body 30 are preferably encased in a common, integral portion of the second body 30 to create a particularly robust form factor.

Figure 2:
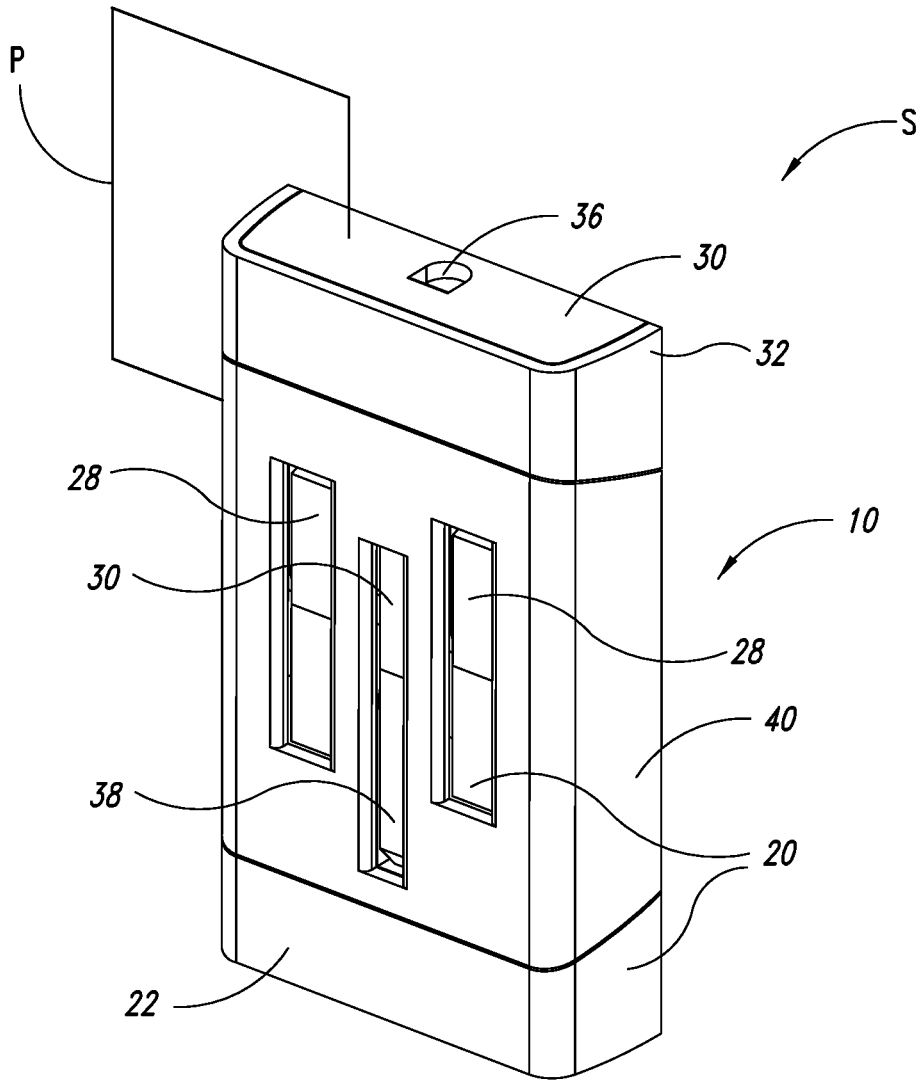
FIG. 2 is an isometric view of the electrical plug device of FIG. 1 in a stowed configuration.
Figure 3:
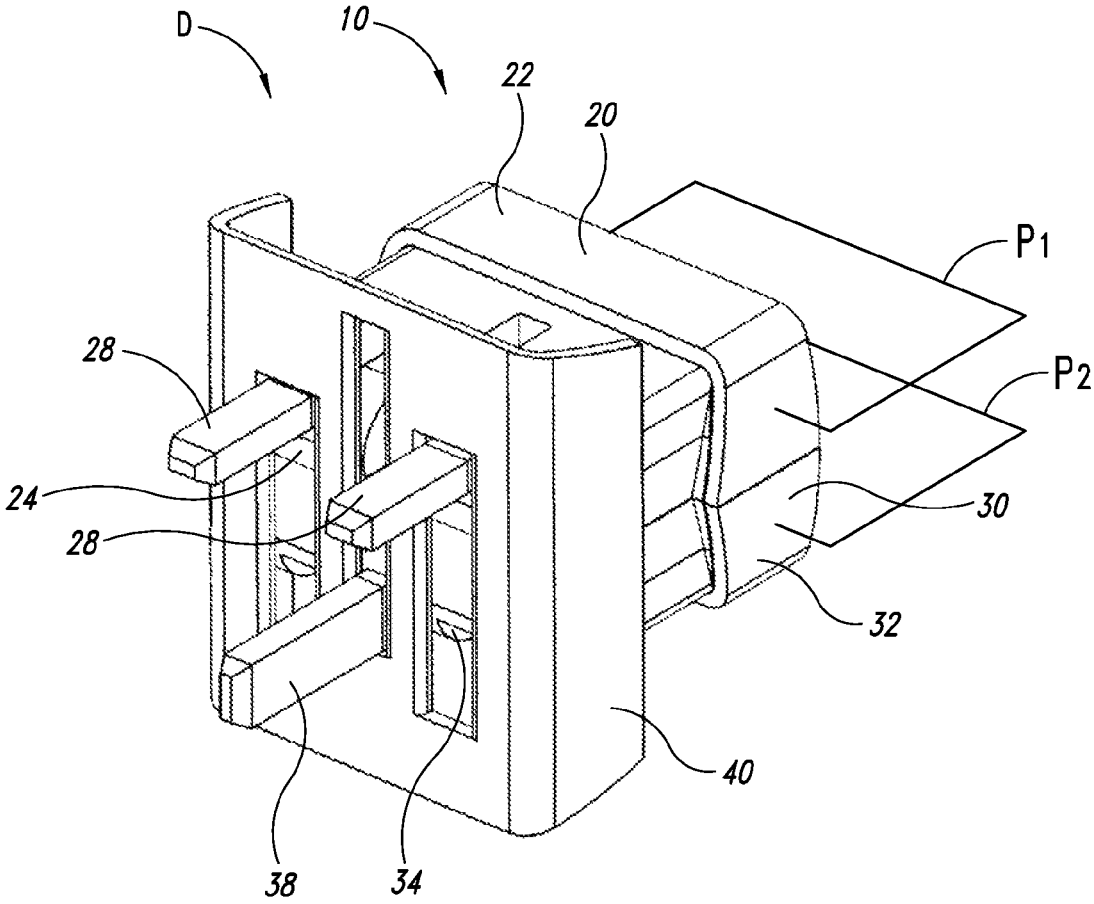
FIG. 3 is a front isometric view of the electrical plug device of FIG. 1 in a deployed configuration.

The first body 20 and the second body 30 are coupled together such that the first body 20 and the second body 30 can move between a stowed configuration S (FIG. 2) and a deployed configuration D (FIG. 3). As shown in FIG. 2, when the adaptor 10 is in the stowed configuration S, the first body 20 and the second body 30 may be substantially aligned in a common plane P. In this manner, the adaptor 10 has a slender, elongated form when it is in the stowed configuration S, which is particularly well suited for storing the adaptor 10 when the adaptor 10 is not in use. The bodies 20, 30 may also nest together or overlap each other when in the stowed configuration S. In this manner, the overall size of the adaptor 10 in the stowed configuration S may be minimized.

Conversely, as shown in FIG. 3, when the adaptor 10 is in the deployed configuration D, the first body 20 and the second body 30 are substantially aligned in parallel offset planes P1, P2. The bodies 20, 30 may ultimately come to rest in a position in which the bodies 20, 30 abut each other to cooperatively form an adaptor plug and an adaptor socket at respective ends of the adaptor 10. In this manner, the bodies 20, 30 combine at one end to form an adaptor socket for receiving an electrical plug 12 of a first type and combine at an opposing end to form an adaptor plug for insertion into an electrical socket 16 of a different type.

Figures 4A, 4B, 4C, 4D:
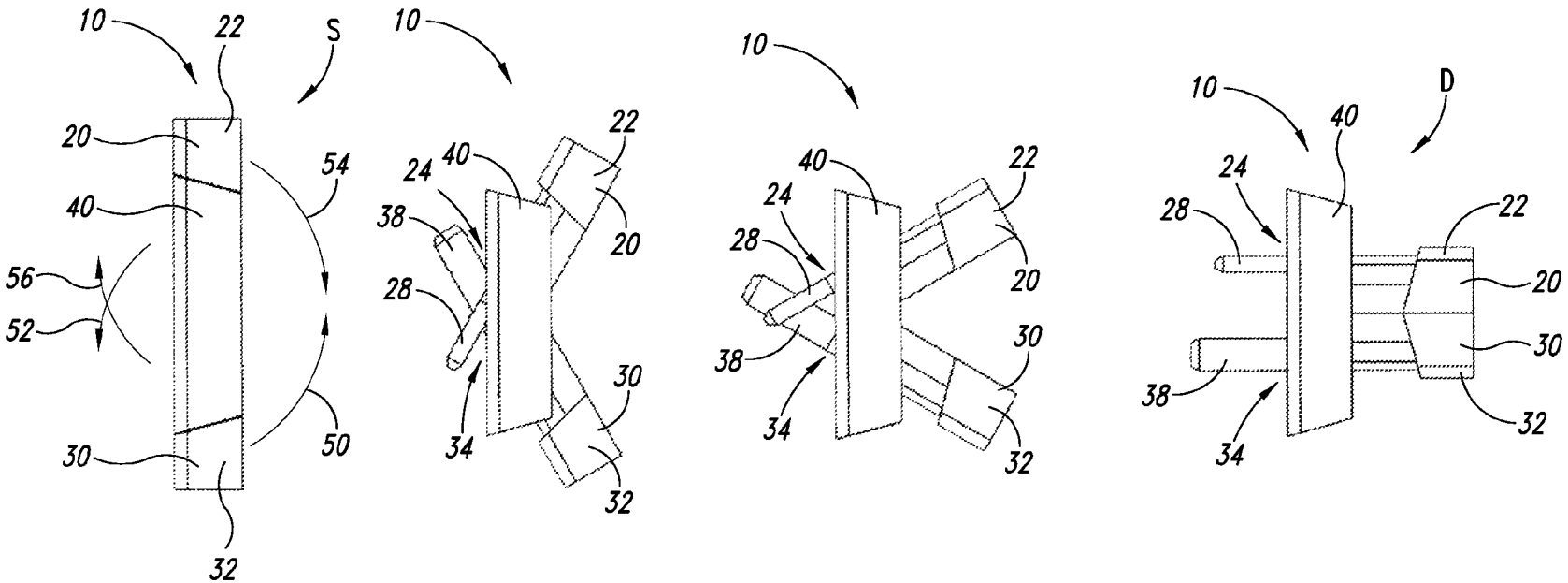
FIGS. 4A-4D illustrate the transition of the electrical plug device of FIG. 1 from the stowed configuration (FIG. 4A) to the deployed configuration (FIG. 4D).

The transition between the stowed configuration S and the deployed configuration D is best illustrated in FIGS. 4A-4D. From the stowed position S, one end 22 of the first body 20 rotates from a distal end of the stowed adaptor 10 towards a central position, as indicated by the arrow 50, while the other end 24 of the first body 20 rotates in the direction indicated by the arrow 52. Similarly, one end 32 of the second body 30 rotates from an opposing distal end of the stowed adaptor 10 towards a central position, as indicated by the arrow 54, while the other end 34 of the second body 30 rotates in the direction indicated by the arrow 56. The bodies 20, 30 continue through the sequence of positions illustrated in FIGS. 4B and 4C until arriving at the deployed configuration D, as shown in FIG. 4D. In the deployed configuration D, opposing ends of the first body 20 cooperate with opposing ends of the second body 30 to provide a coupling interface for an electrical plug 12 and an electrical socket 16 of different types. Although the illustrated embodiment shows the bodies 20, 30 operating in pure rotational movements, it is contemplated that in other embodiments, the bodies 20, 30 may rotate, slide and/or pivot with respect to each other when transitioning between a stowed configuration and a deployed configuration.

Figure 5:
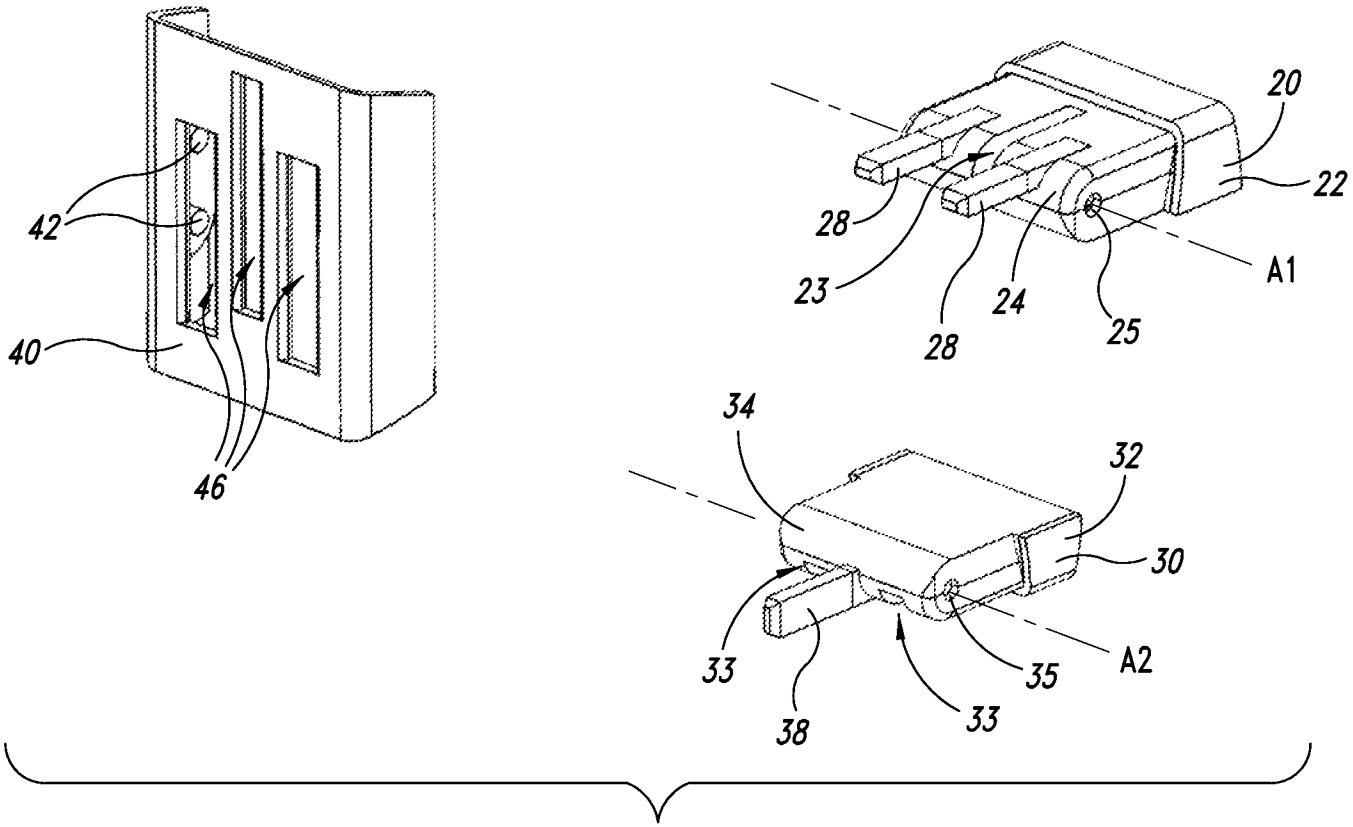
FIG. 5 is an exploded isometric view of the electrical plug device of FIG. 1.

Further details of the adaptor 10 are shown in the exploded view of FIG. 5. As shown in the illustrated embodiment of FIG. 5, a linkage 40 may be provided for coupling the first body 20 and the second body 30 to each other. The linkage 40 may have a general frame structure and include clips, snaps, tabs, protrusions, detents or other coupling structures for mating with each of the adaptor bodies 20, 30. For instance, the linkage may include protrusions 42 formed on side wall portions of the linkage 40 for engaging respective apertures 25, 35 in the adaptor bodies 20, 30 such that the bodies are securely coupled to the linkage 40 (and hence each other) while being able to rotate about respective pivot axes A1, A2. Additional clips, snaps, tabs, protrusions, detents or other coupling structures (not shown) may be provided for temporarily holding or restraining the adaptor bodies 20, 30 in the stowed configuration S and/or the deployed configuration D.

Clearance windows or apertures 46 may be provided to enable the adaptor bodies 20, 30 to rotate or pivot relative to the linkage 40 from the stowed configuration S to the deployed configuration D. When the adaptor 10 is in the stowed configuration S, a longitudinal length of the linkage 40 may be aligned substantially parallel to a direction defined between opposing ends 22, 24 of the first body 20 and opposing ends 32, 34 of the second body 30, as shown in FIG. 2. Conversely, when the adaptor 10 is in the deployed configuration D, a longitudinal length of the linkage 40 may be perpendicularly aligned to a direction defined between opposing ends 22, 24 of the first body 20 and opposing ends 32, 34 of the second body 30, as shown in FIG. 3.

The adaptor bodies 20, 30 can further include complementary shapes which nest together or overlap each other when the adaptor 10 is in the stowed configuration S. For example, one end 24 of first body 20 may have opposing legs spaced apart to form a central cavity 23. The central cavity 23 may be sized to receive a male contact at one end 34 of the other adaptor body 30 when the adaptor 10 is in the stowed configuration S. As another example, the second body 30 may include recesses 33 for accommodating male contacts 28 protruding from the end 24 of the first body 20 when the adaptor 10 is in the stowed configuration S. In this manner, the adaptor 10 is able to transition into a particularly slender and short form factor when in the stowed configuration S. In some embodiments, a thickness of the adaptor 10 in the stowed configuration S is about half of the height of the face of the adaptor plug interface that is formed when the adaptor 10 is in the deployed configuration D. In some embodiments, a height of the adaptor 10 in the stowed configuration S is about 1.20 times the overall width of the adaptor 10 in the deployed configuration D or less.

Figure 6:
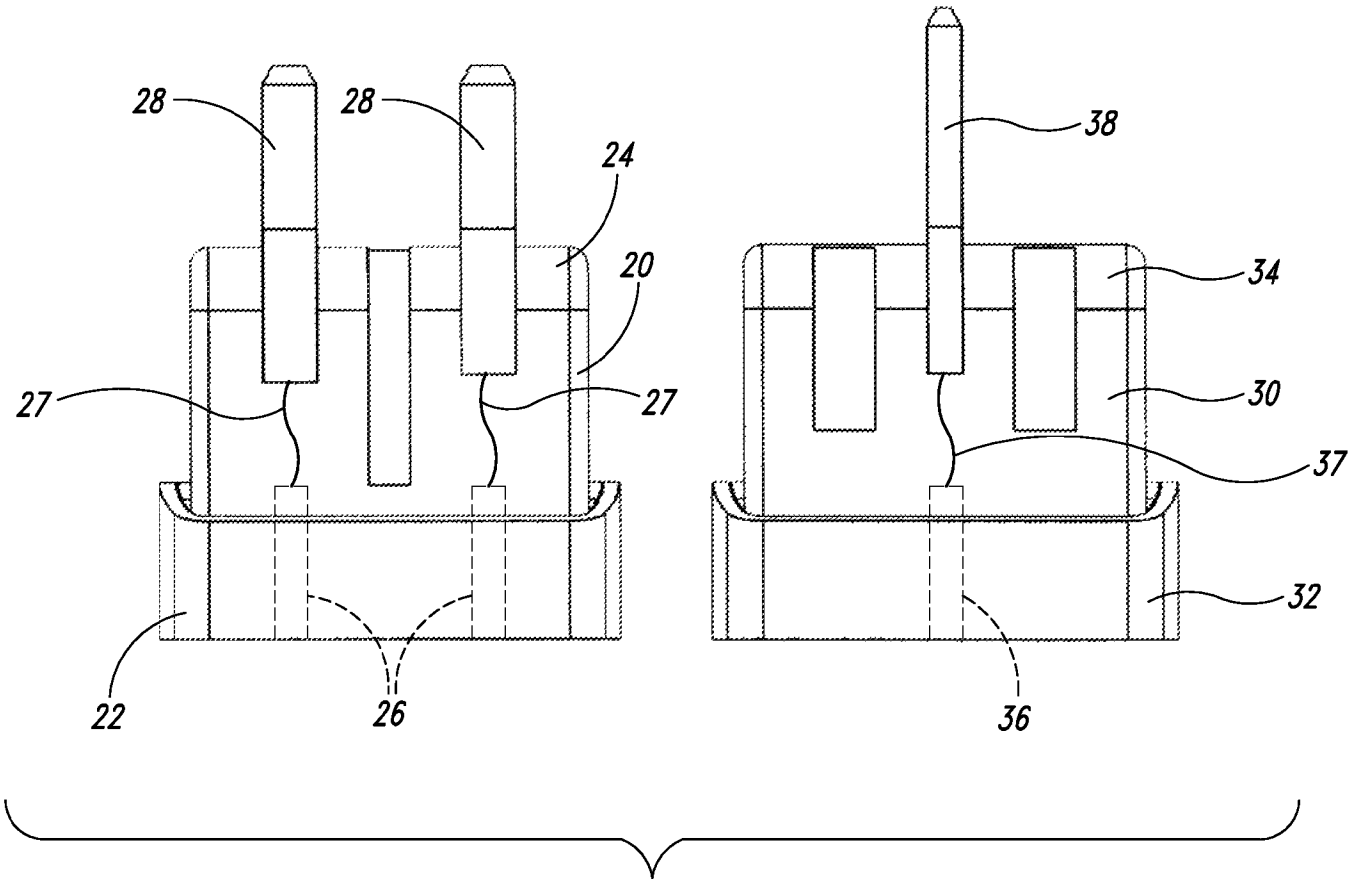
FIG. 6 is a top schematic view of body portions of the electrical plug device of FIG. 1 illustrating electrical connections thereof.

FIG. 6 is a schematic illustration of electrical connections of the adaptor bodies 20, 30. Electrical conductors 27 extend within the first body 20 between opposing ends thereof 22, 24 and terminate in electrical contacts 26, 28. The combination of the electrical conductors 27 and contacts 26, 28 of the first body 20 enable the adaptor 10 to complete of an electrical circuit when the adaptor 10 is in use. Similarly, an electrical conductor 37 extends within the second body 30 between opposing ends thereof 32, 34 and terminates in electrical contacts 36, 38. The combination of the electrical conductor 37 and contacts 36, 38 of the second body 30 enable the adaptor 10 to ground the electrical circuit completed in the first body 20 when the adaptor 10 is in use. In this manner, and according to the illustrated embodiment, the live conductors or wires are disposed in one body 20 while the ground conductor or wire is disposed in a separate body 30. Each of the bodies 20, 30 are preferably formed as rigid components such that the conductive paths disposed therein provide direct connections between respective contacts of an electrical plug and socket interconnected with the adaptor 10. In this manner, the adaptor 10 provides a particularly robust form factor that is less susceptible to wear, failure and short circuits as compared to known adaptors having movable contacts.

Figure 7:
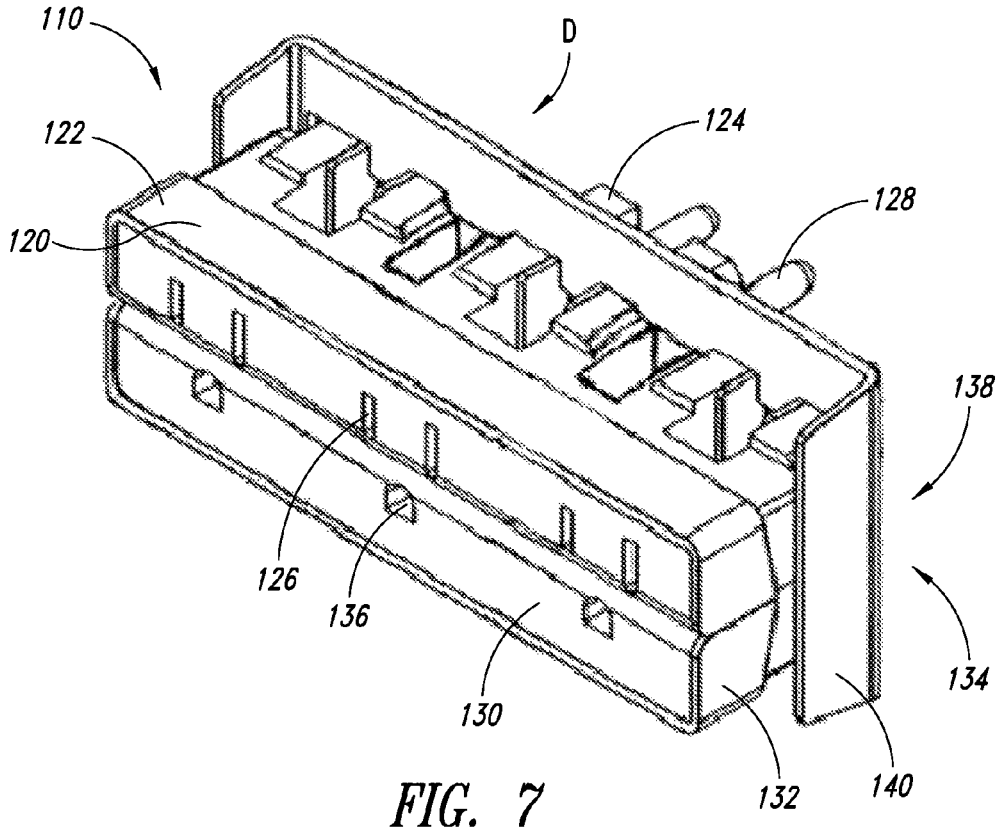
FIG. 7 is a rear isometric view of an electrical plug device, according to another embodiment.

FIG. 7 shows an adaptor 110, according to one embodiment, for establishing an electrical connection between multiple electrical plugs of one type and an electrical socket of another type. Such an embodiment may be advantageous, for example, when one desires to plug in multiple electrical devices to a socket that, absent the adaptor 110, is not compatible with such devices. In some embodiments, the adaptor 110 may also include various well known circuit components such that the adaptor 110 is configured to operate as a surge protector.

The adaptor 110 may include a first body 120 and a second body 130 which cooperate to form a coupling interface for multiple electrical plugs of one type (e.g., NEMA 5 type) and an electrical socket of another type (e.g., CEE 7/5 Type E socket or BS 1363 socket). The first body 120 may include opposing ends 122, 124 with electrical conductors extending therebetween and terminating in electrical contacts. More particularly, at one end 122, the first body 120 may include multiple pairs of female contacts 126 configured to receive corresponding pairs of male contacts of electrical plugs. At the other end 124, the first body 120 may include a pair of male contacts 128 configured to be insertably received in female contacts of an electrical socket. Each pair of female contacts 126 of the first body 120 may be fixedly and electrically coupled to the male contacts 128 to enable completion of one or more electrical circuits through the adaptor 110 when the adaptor 110 is in use without reliance on brush contacts or the like. The conductors and contacts 126, 128 of the first body 120 are preferably encased in a common, integral portion of the first body 120 to create a particularly robust form factor.

The second body 130 may include opposing ends 132, 134 with electrical conductors extending therebetween and terminating in electrical contacts. More particularly, at one end 132, the second body 130 may include a female contact 136 corresponding to each of the pairs of female contacts 126 of the first body 120, wherein each of the female contacts 136 of the second body 130 are configured to receive a corresponding male grounding contact of an electrical plug. At the other end 134, the second body 130 may include a grounding contact 138 (not shown) configured to interface with a corresponding grounding contact of the electrical socket. The grounding contacts 136, 138 of the second body 130 may be fixedly coupled together to provide grounding of the one or more electrical circuits through the adaptor 110 when the adaptor 110 is in use. The conductors and grounding contacts 136, 138 of the second body 130 are preferably encased in a common, integral portion of the second body 130 to create a particularly robust form factor.

The first body 120 and the second body 130 may be coupled together such that the first body 120 and the second body 130 can move between a stowed configuration (not shown) and a deployed configuration D, as shown in FIG. 7. When the adaptor 110 is in the stowed configuration, the first body 120 and the second body 130 may be substantially aligned in a common plane. The bodies 120, 130 may also nest together or overlap each other when in the stowed configuration. Conversely, when the adaptor 110 is in the deployed configuration D, the first body 120 and the second body 130 may be substantially aligned in parallel offset planes. The bodies 120, 130 may abut each other in the deployed configuration D.

Figure 8:
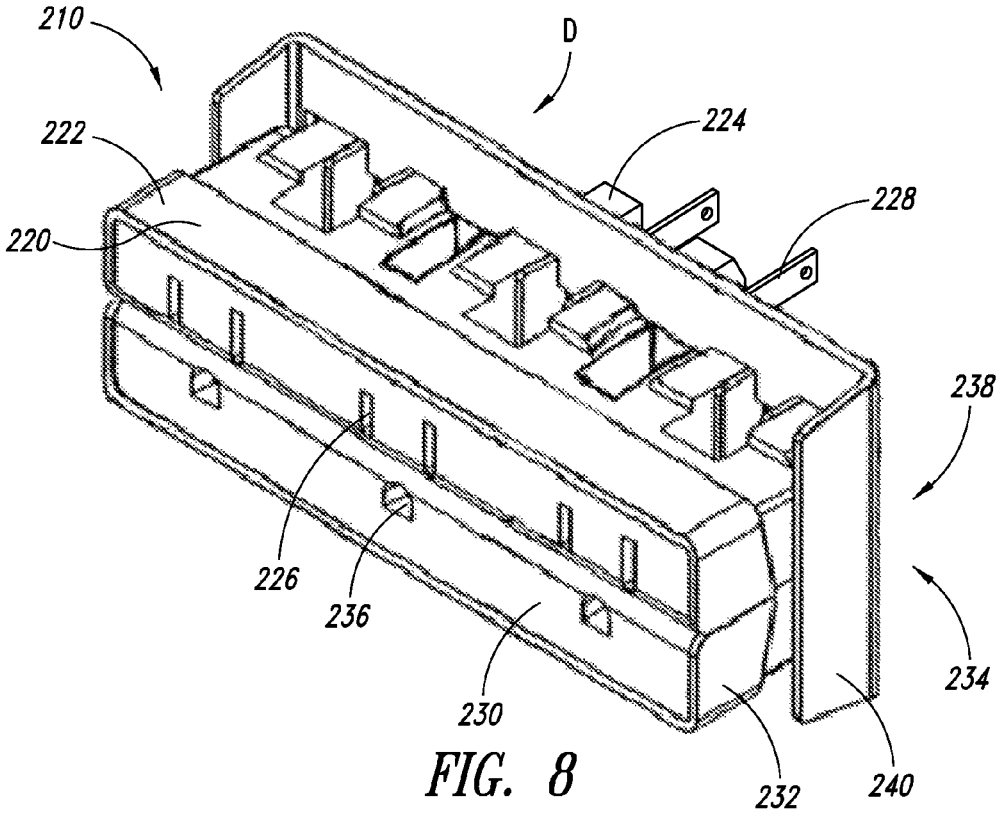
FIG. 8 is a rear isometric view of an electrical plug device, according to still yet another embodiment.

FIG. 8 shows an electrical plug device in the form of a multi-socket plug 210, according to one embodiment, for establishing an electrical connection between multiple electrical plugs of one type and an electrical socket of the same type (e.g., NEMA 5 type plugs and socket). Such an embodiment may be advantageous, for example, when one desires to plug in multiple electrical devices to the same socket. In some embodiments, the multi-socket plug 210 may also include various well known circuit components such that the multi-socket plug 210 is configured to operate as a surge protector.

The multi-socket plug 210 may include a first body 220 and a second body 230. The first body 220 may include opposing ends 222, 224 with electrical conductors extending therebetween and terminating in electrical contacts. More particularly, at one end 222, the first body 220 may include multiple pairs of female contacts 226 configured to receive corresponding pairs of male contacts of electrical plugs. At the other end 224, the first body 220 may include a pair of male contacts 228 configured to be insertably received in female contacts of an electrical socket. Each pair of the female contacts 226 of the first body 220 may be fixedly and electrically coupled to the male contacts 228 to enable completion of one or more electrical circuits through the multi-socket plug 210 when the multi-socket plug 210 is in use without reliance on brush contacts or the like. The conductors and contacts 226, 228 of the first body 220 are preferably encased in a common, integral portion of the first body 220 to create a particularly robust form factor.

The second body 230 may include opposing ends 232, 234 with electrical conductors extending therebetween and terminating in electrical contacts. More particularly, at one end 232, the second body 230 may include a female contact 236 corresponding to each of the pairs of female contacts 226 of the first body 220, and wherein each of the female contacts 236 of the second body 230 are configured to receive a corresponding male grounding contact of an electrical plug. At the other end 234, the second body 230 may include a grounding contact 238 (not shown) configured to interface with a corresponding grounding contact of the electrical socket. The grounding contacts 236, 238 of the second body 230 may be fixedly coupled together to provide grounding of the one or more electrical circuits through the multi-socket plug 210 when the multi-socket plug 210 is in use. The conductors and grounding contacts 236, 238 of the second body 230 are preferably encased in a common, integral portion of the second body 230 to create a particularly robust form factor.

The first body 220 and the second body 230 may be coupled together such that the first body 220 and the second body 230 can move between a stowed configuration (not shown) and a deployed configuration D, as shown in FIG. 8. When the multi-socket plug 210 is in the stowed configuration, the first body 220 and the second body 230 may be substantially aligned in a common plane. The bodies 220, 230 may also nest together or overlap each other when in the stowed configuration. Conversely, when the multi-socket plug 210 is in the deployed configuration D, the first body 220 and the second body 230 may be substantially aligned in parallel offset planes. The bodies 220, 230 may abut each other in the deployed configuration D.

FIGS. 9 through 13 show an electrical plug device in the form of a multi-socket plug 310, according to one embodiment. The multi-socket plug 310 is configured to establish an electrical connection between multiple electrical plugs of one type and an electrical socket of the same type (e.g., NEMA 5 type plugs and socket). In other embodiments, the multi-socket plug 310 may be configured to establish an electrical connection between multiple electrical plugs of one type and an electrical socket of a different type. Such devices may be advantageous, for example, when one desires to plug in multiple electrical devices to the same socket. In some embodiments, the multi-socket plug 310 may also include various well known circuit components such that the multi-socket plug 310 is configured to operate as a surge protector. In addition, the multi-socket plug 310 may provide USB charging ports 312 for charging various electronic devices, such as, for example, smart phones.

The multi-socket plug 310 may include a first body 320 and a second body 330. The first body 320 may include opposing ends 322, 324 with electrical conductors extending therebetween and terminating in electrical contacts. More particularly, at one end 322, the first body 320 may include multiple pairs of female contacts 326 configured to receive corresponding pairs of male contacts of electrical plugs. At the other end 324, the first body 320 may include a pair of male contacts 328 configured to be insertably received in female contacts of an electrical socket. Each pair of the female contacts 326 of the first body 320 may be fixedly and electrically coupled to the male contacts 328 to enable completion of one or more electrical circuits through the multi-socket plug 310 when the multi-socket plug 310 is in use without reliance on brush contacts or the like. The conductors and contacts 326, 328 of the first body 320 may be encased in a common, integral portion of the first body 320 to create a particularly robust form factor. In other instances, voids or cavities may be provided amid the conductors and contacts 326, 328 to house circuit components for surge protection and/or USB charging functionality.

The second body 330 may include opposing ends 332, 334 with electrical conductors extending therebetween and terminating in electrical contacts. More particularly, at one end 332, the second body 330 may include a female contact 336 corresponding to each of the pairs of female contacts 326 of the first body 320, and wherein each of the female contacts 336 of the second body 330 are configured to receive a corresponding male grounding contact of an electrical plug. At the other end 334, the second body 330 may include a grounding contact 338 configured to interface with a corresponding grounding contact of the electrical socket. The grounding contacts 336, 338 of the second body 330 may be fixedly coupled together to provide grounding of the one or more electrical circuits through the multi-socket plug 310 when the multi-socket plug 310 is in use. The conductors and grounding contacts 336, 338 of the second body 330 may be encased in a common, integral portion of the second body 330 to create a particularly robust form factor. In other instances, voids or cavities may be provided amid the conductors and grounding contacts 336, 338 to house circuit components for surge protection and/or USB charging functionality.

Figure 9:
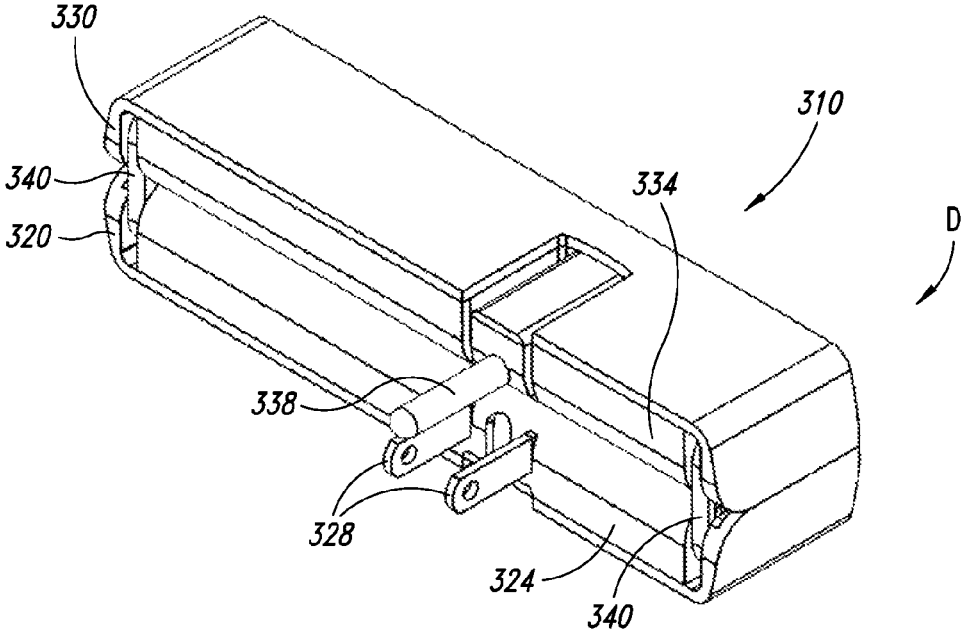
FIG. 9 is a rear isometric view of an electrical multi-socket plug, according to one embedment, shown in a deployed configuration.
Figure 10:
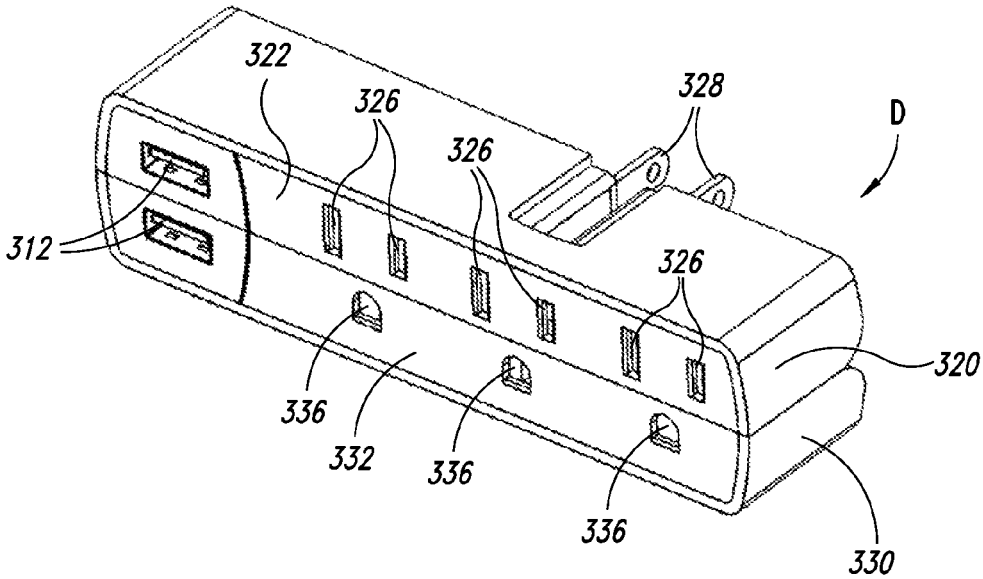
FIG. 10 is a front isometric view of the electrical multi-socket plug of FIG. 9 shown in the deployed configuration.
Figure 11:
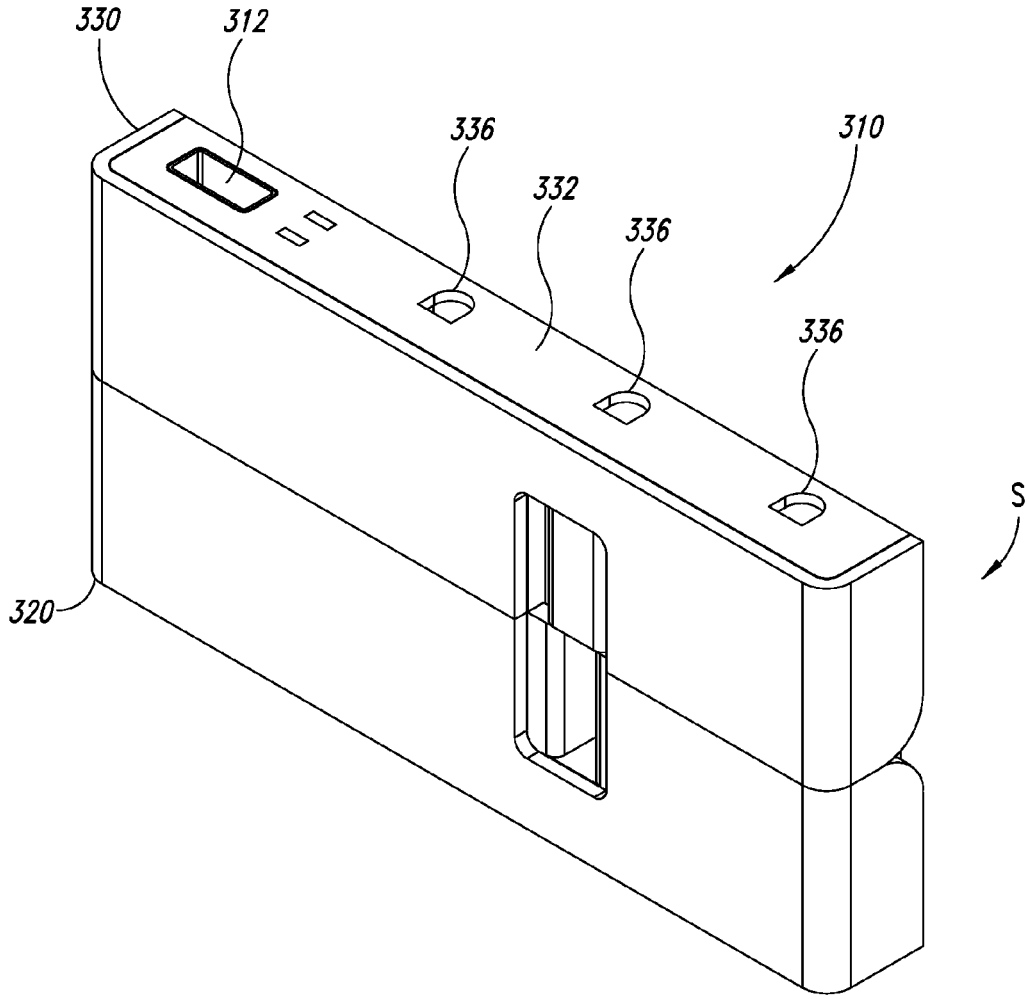
FIG. 11 is a rear isometric view of the electrical multi-socket plug of FIG. 9 shown in a stowed configuration.
Figure 12:
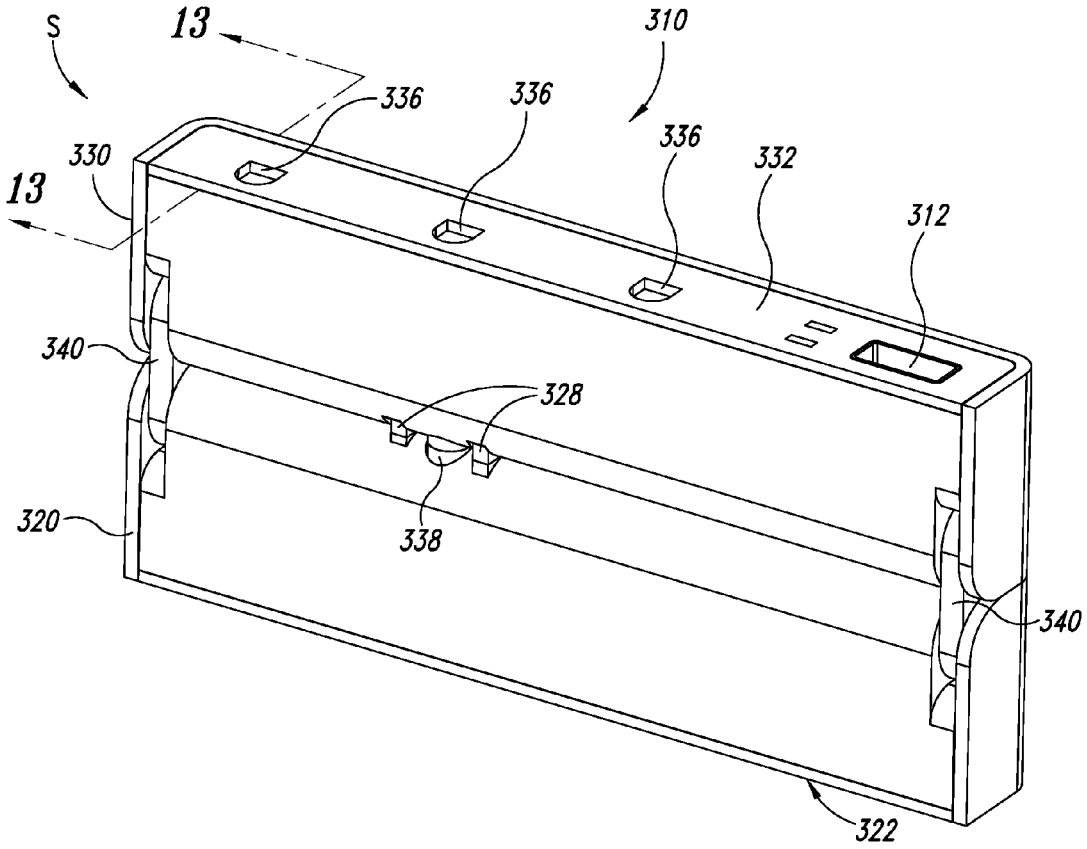
FIG. 12 is a front isometric view of the electrical multi-socket plug of FIG. 9 shown in the stowed configuration.

The first body 320 and the second body 330 may be coupled together such that the first body 320 and the second body 330 can move between a stowed configuration S, as shown in FIGS. 11 and 12, and a deployed configuration D, as shown in FIGS. 9 and 10. When the multi-socket plug 310 is in the stowed configuration, the first body 320 and the second body 330 may be substantially aligned in a common plane or generally collinear manner. The bodies 320, 330 may in some instances nest together or overlap each other when in the stowed configuration S. In other instances, the bodies 320, 330 may align in an abutting end-to-end relationship. Conversely, when the multi-socket plug 310 is in the deployed configuration D, the first body 320 and the second body 330 may be substantially aligned in parallel offset planes. The bodies 320, 330 may abut each other in the deployed configuration D in a side-by-side relationship.

Figure 13:
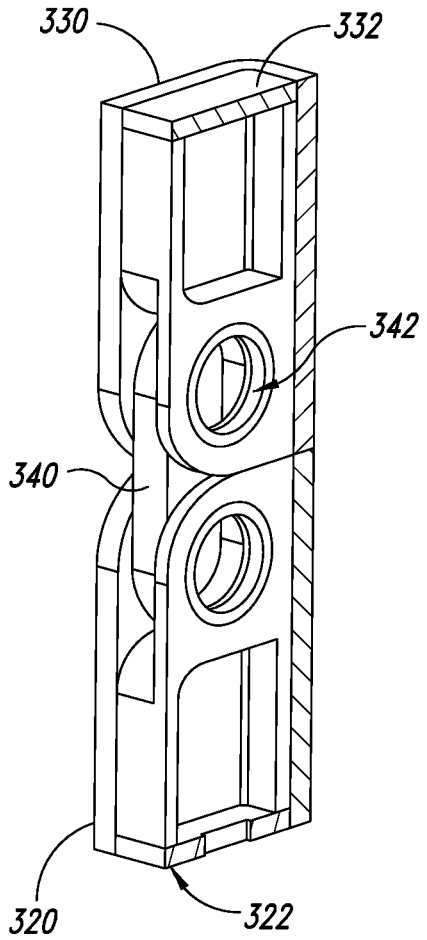
FIG. 13 is an isometric cross-sectional view of the electrical multi-socket plug taken along line 13-13 of FIG. 12.

As shown in the illustrated embodiment of FIG. 12 and corresponding cross-sectional view of FIG. 13, linkages 340 may be provided for coupling the first body 320 and the second body 330 to each other. The linkages 340 may have a general oval structure and may include clips, snaps, tabs, protrusions, detents or other coupling structures for mating with each of the device bodies 320, 330. The linkages 340 may be located predominately or entirely within an outer profile of the multi-socket plug 310. The linkages 340 may also have a hallow structure which defines a path 342 for routing electrical conductors between the device bodies 320, 330. In this manner, power may be supplied from the contacts 328 of the first body 320 through one or more of the linkages 340 and to a USB charging port 312 of the second body 330, for example. Additional clips, snaps, tabs, protrusions, detents or other coupling structures (not shown) may be provided for temporarily holding or restraining the device bodies 320, 330 in the stowed configuration S (FIGS. 11 and 12) and/or the deployed configuration D (FIGS. 9 and 10).

With reference back to FIGS. 1 through 6, a method of making an electrical plug device, such as an adaptor 10, may include forming a first body 20 to include a pair of electrical conductors 27 extending between opposing ends 22, 24 thereof to interface with an electrical plug 12 and an electrical socket 16 and enable completion of an electrical circuit therebetween. The method may also include forming a second body 30 to include an electrical conductor 37 extending between opposing ends 32, 34 thereof to interface with the electrical plug 12 and the electrical socket 16 and provide grounding therebetween. The method may further include coupling the first body 20 and the second body 30 together to move between a stowed configuration S in which the first body 20 and the second body 30 are aligned in parallel and/or nest together and a deployed configuration D in which the opposing ends 22, 24 of the first body 20 and the opposing ends 32, 34 of the second body 30 cooperate to provide a coupling interface for the electrical plug 12 and the electrical socket 16. Forming the first body 20 may include forming the first body 20 to include a pair of female contacts 26 at one of the opposing ends 22 and a pair of male contacts 28 at the other one of the opposing ends 24, with the female contacts 26 and the male contacts 28 being electrically connected by the electrical conductors 27 to enable completion of the electrical circuit when the electrical plug device is in use. Forming the second body 30 may include forming the second body 30 to include a grounding contact 36, 38 at each of the opposing ends 32, 34 thereof, the grounding contacts 36, 38 connected by the electrical conductor 37 to provide grounding of the electrical circuit when the electrical plug device is in use. Accordingly, making an electrical plug device with a particularly small, robust form factor that is transformable between a stowed configuration S and deployed configuration D to establish an electrical connection between an electrical plug and an electrical socket of different types is possible.

Although the device bodies 20, 30, 120, 130, 220, 230, 330 of the embodiments shown in FIGS. 1 through 13 are coupled together by one or more linkages 40, 140, 240, 340 it is appreciated that the device bodies 20, 30, 120, 130, 220, 230, 330 may be directly connected to each other in some embodiments. In some embodiments, the device bodies 20, 30, 120, 130, 220, 230, 330 may be connected with fasteners, such as, for example, pins, screws or rivets. Irrespective of the connection structure, however, the device bodies 20, 30, 120, 130, 220, 230, 330 are positioned and shaped relative to each other to allow movement from a stowed configuration S in which the device 10, 110, 210, 310 is in a particularly slender arrangement and a deployed configuration D in which the device 10, 110, 210, 310 is positioned to enable an electrical connection between one or more electrical plugs and an electrical socket. The device 10, 110, 210, 310 may easily transition between these configurations with minimal force applied by a user.

Moreover, the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A device for establishing an electrical connection between an electrical plug and an electrical socket, the device comprising:

a first body having opposing ends, the first body including a pair of female contacts at one end configured to receive male contacts of the electrical plug and a pair of male contacts at the other end configured to be insertably received in female contacts of the electrical socket, the female contacts of the first body fixedly coupled to the male contacts of the first body to enable completion of an electrical circuit when the device is in use; and a second body having opposing ends, the second body including a grounding contact at each of the opposing ends, the grounding contacts fixedly coupled together to provide grounding of the electrical circuit when the device is in use, and wherein the device is movable from a stowed configuration to a deployed configuration in which the opposing ends of the first body and the opposing ends of the second body cooperate to provide a coupling interface for the electrical plug and the electrical socket, and wherein, when the device is in the stowed configuration, the first body and the second body are substantially aligned in a common plane.

2. The device of claim 1 wherein, when the device is in the deployed configuration, the first body and the second body are aligned in parallel offset planes.

3. The device of claim 1 wherein, when the device moves from the stowed configuration to the deployed configuration, the first body and the second body rotate.

4. The device of claim 1 wherein, when the device is in the stowed configuration, the first body and the second body nest together.

5. The device of claim 1 wherein, when the device is in the stowed configuration, the first body and the second body abut each other end-to-end.

6. The device of claim 1 wherein, when the device is in the stowed configuration, the first body and the second body overlap each other when viewed from a side of the device.

7. The device of claim 1 wherein, when the device is in the stowed configuration, the first body and the second body form a structure having a generally constant thickness when viewed from a side of the device.

8. The device of claim 1, further comprising:

a linkage coupled to each of the first body and the second body.

9. The device of claim 8 wherein the linkage is hollow and defines a path therethrough.

10. The device of claim 8 wherein, when the device is in the deployed configuration, a longitudinal length of the linkage is perpendicularly aligned to a direction defined between the opposing ends of the first body.

11. The device of claim 8 wherein, when the device is in the stowed configuration, a longitudinal length of the linkage is aligned substantially parallel to a direction defined between the opposing ends of the first body.

12. The device of claim 1 wherein the first body includes at least two pairs of female contacts at one end thereof such that the device is configured to establish an electrical connection between at least two electrical plugs and an electrical socket when the device is in use.

13. The device of claim 12 wherein the device is configured to establish an electrical connection between at least two electrical plugs and an electrical socket of the same type when the device is in use.

14. The device of claim 12 wherein the device is configured to establish an electrical connection between at least two electrical plugs of the same type and an electrical socket of a different type when the device is in use.

15. The device of claim 1 wherein at least one of the first body and the second body includes a USB charging port.

16. The device of claim 1 wherein each of the first body and the second body includes a USB charging port.

17. A device for establishing an electrical connection between an electrical plug and an electrical socket, the device comprising:

a first body having opposing ends; and a second body having opposing ends, the first body and the second body coupled together to move between a stowed configuration in which the first body and second body are substantially aligned in a common plane and a deployed configuration in which one end of the first body and one end of the second body cooperate to form a device socket for the electrical plug and in which the other end of the first body and the other end of the second body cooperate to form a device plug for the electrical socket.

18. The device of claim 17 wherein the first body includes a pair of female contacts at one of the opposing ends which are fixedly coupled to a pair of male contacts at the other one of the opposing ends to enable completion of an electrical circuit when the device is in use.

19. The device of claim 18 wherein the second body includes a grounding contact at each of the opposing ends thereof, the grounding contacts fixedly coupled together to provide grounding of the electrical circuit when the device is in use.

20. The device of claim 17, further comprising:

a linkage coupled to each of the first body and the second body such that, when the device is in the stowed configuration, the linkage is aligned substantially parallel to the first body and the second body, and, when the device is in the deployed configuration, the linkage is substantially perpendicularly aligned to the first body and the second body.

21. The device of claim 20 wherein the linkage includes a passage to route electrical conductors between the first body and the second body.

22. The device of claim 17 wherein, when the device is in the deployed configuration, the device socket is configured to receive a NEMA 5 type electrical plug and the device plug is configured to be received in a type of electrical socket other than a NEMA 5.

23. The device of claim 17 wherein the first body includes at least two pairs of female contacts at one of the opposing ends thereof such that the device is configured to establish an electrical connection between at least two electrical plugs and an electrical socket when the device is in use.

24. The device of claim 23 wherein the device is configured to establish an electrical connection between at least two electrical plugs and an electrical socket of the same type when the device is in use.

25. The device of claim 23 wherein the device is configured to establish an electrical connection between at least two electrical plugs of the same type and an electrical socket of a different type when the device is in use.

26. A method of making a device for establishing an electrical connection between an electrical plug and an electrical socket, the method comprising:

forming a first body to include a pair of electrical conductors extending between opposing ends thereof to interface with the electrical plug and the electrical socket and enable completion of an electrical circuit therebetween;

forming a second body to include an electrical conductor extending between opposing ends thereof to interface with the electrical plug and the electrical socket and provide grounding therebetween; and coupling the first body and the second body together to move between a stowed configuration in which the first body and the second body align together in a generally collinear manner and a deployed configuration in which the opposing ends of the first body and the opposing ends of the second body cooperate to provide a coupling interface for the electrical plug and the electrical socket.

27. The method of claim 26 wherein forming the first body to include the pair of electrical conductors extending between opposing ends thereof includes forming the first body to include a pair of female contacts at one of the opposing ends and a pair of male contacts at the other one of the opposing ends, the female contacts and the male contacts connected by the electrical conductors to enable completion of the electrical circuit when the device is in use.

28. The method of claim 27 wherein forming the second body to include the electrical conductor extending between opposing ends thereof includes forming the second body to include a grounding contact at each of the opposing ends, the grounding contacts connected by the electrical conductor to provide grounding of the electrical circuit when the device is in use.

* * * * *